United States Patent [19]

Reiff

[11] 3,989,515

[45] Nov. 2, 1976

[54] ALLOYS FOR TENSION BANDS

[75] Inventor: Karl H. Reiff, Belm, Germany

[73] Assignee: Carl Haas, Schramberg, Germany

[22] Filed: June 9, 1975

[21] Appl. No.: 585,442

Related U.S. Application Data

[63] Continuation-in-part of Ser. No. 33,007, Feb. 9, 1973, Pat. No. 3,907,556.

[30] Foreign Application Priority Data

Feb. 11, 1972 Germany ..... 2206397

[52] U.S. Cl. ..... 75/172 R; 75/172 G

[51] Int. Cl.[2] ..... C22C 5/04

[58] Field of Search ..... 75/172 G, 172 R; 324/154 PB, 154 R

[56] References Cited

UNITED STATES PATENTS

| | | | |
|---|---|---|---|
| 2,172,512 | 9/1939 | Kilgallon | 75/172 G |
| 3,134,671 | 5/1964 | Prosen | 75/172 G |
| 3,245,781 | 4/1966 | Durer et al. | 75/172 R |
| 3,374,123 | 3/1968 | Masumoto et al. | 75/172 G X |

FOREIGN PATENTS OR APPLICATIONS

| | | | |
|---|---|---|---|
| H18,678 | 12/1956 | Germany | 75/172 R |
| 646,899 | 11/1950 | United Kingdom | 75/172 G |

*Primary Examiner*—L. Dewayne Rutledge
*Assistant Examiner*—E. L. Weise
*Attorney, Agent, or Firm*—Spencer & Kaye

[57] ABSTRACT

High quality factor, low torsion modulus alloys especially useful as tension bands for measuring instruments are composed essentially of platinum or palladium admixed with at least one element of Groups III, IV, V and VI of the Periodic Table excluding boron, carbon, nitrogen and oxygen.

19 Claims, No Drawings

ALLOYS FOR TENSION BANDS

CROSS-REFERENCE TO RELATED APPLICATION

This application is a continuation-in-part of my previously filed, copending application Ser. No. 331,007, filed on Feb. 9th, 1973, now U.S. Pat. No. 3,907,556, dated Sept. 23, 1975 and hereby incorporated by reference.

BACKGROUND OF THE INVENTION

For measuring instruments having a rotatable measuring mechanism it is known to eliminate bearing friction by using taut strip suspended or tension band mounted measuring mechanisms. Previously such a taut strip suspension or tension band mounting was realized only in galvanometers and similar highly sensitive laboratory instruments due to their high mechanical sensitivity as regards shock and vibration and in view of their position dependency. With suitable structural measures for fastening the taut strips and for absorbing shocks and vibrations on the one hand and with improvements of the properties of the tape materials on the other hand, the mounting has now been perfected to such a degree that it can be used successfully today even in shock-resistant switchboards.

A taut strip or tension band must perform three functions:

1. it forms the bearing for the measuring mechanism;
2. it provides current to the measuring mechanism; and
3. it imparts the required resetting moment to the measuring mechanism.

The requirements placed on the taut strip due to the simultaneous performance of these three functions are very high and often exclude one another due to their opposite nature. As a bearing, the strip must have the highest tensile strength without being brittle in order to be able to withstand shocks and vibrations. In the interest of high sensitivity, a small reset moment is required. This means that materials for taut strips must have as high as possible a breaking strength factor $\sigma_B$ on the one hand and as low as possible a modulus of torsion G. The suitability of a material for tensioning belts is thus characterized by a parameter or quality factor Z which is equal to the breaking strength divided by the square root of the modulus of torsion of the respective material.

In addition to the breaking strength and torsion modulus, the tension band material must be corrosion resistant, workable and easily solderable. For the production of high precision measuring instruments it is additionally important that the elastic after-effect and hysteresis be as low as possible. In certain cases in which low or normal demands are placed on the breaking strength of the taut strip suspension, it is desirable to reduce at least the torsion modulus as much as possible.

Heretofore, platinum/iridium alloys with an iridium content up to 30%, platinum/nickel alloys with a nickel content of 8 to 12.5% and gold/nickel alloys have been preferred for the taut strips. Alloys of the platinum metals (platinum, palladium, rhodium) with 5 to 40% iron, cobalt, nickel, tungsten, molybdenum, copper or silver and 1 to 30% iridium are suggested for fabrication of tension bands in German Pat. No. 1,152,826. Such alloys, according to this patent, exhibit torsion moduli in the order of 6300 with quality factors of about 2.50.

SUMMARY OF THE INVENTION

The present invention relates to the use of an alloy consisting predominantly of palladium and/or platinum as the material for tensioning belts in measuring instruments having a rotatable measuring mechanism.

It is an object of the invention to provide new alloys consisting essentially of palladium or platinum and a member of Groups III, IV, V and VI of the Periodic Table, excluding boron, carbon, nitrogen and oxygen.

It is a further object of this invention to provide such alloys having a high quality factor, low tension modulus and good soldering properties and thus especially suitable for use as tension bands for measuring instruments.

These and other objects will be apparent to those skilled in the art from the following description.

DETAILED DESCRIPTION OF THE INVENTION

The present invention is directed to the problem of providing alloys to be used as taut strip materials, which exhibit a low torsion modulus and a higher quality factor than the alloys previously employed for this purpose.

This is accomplished in accordance with the present invention by certain new alloys predominantly of palladium and/or platinum, to which has been added at least one element from Groups III, IV, V and VI of the Periodic Table, with the exception of boron, carbon, nitrogen and oxygen, in such quantities that the corrosion resistance and workability of the primary component are preserved. The predominant palladium and/or platinum components of the alloys used in the present invention comprise more than 50% by weight of the alloys.

Alloys of palladium with 3.5 to 4.5% aluminum, palladium with 10 to 14% by weight antimony, palladium and preferably 5 to 25 weight % tellurium or of palladium and preferably 5 to 20% gallium, have been found to be particularly advantageous. Particularly low torsion moduli and highest quality factors can be obtained with alloys which contain, in addition to at least one element of Groups III, IV, V and VI of the Periodic Table, gold, silver and/or copper. Examples of such alloys are palladium with 2 to 6% by weight aluminum and 1 to 30% by weight copper and/or silver and palladium with 5 to 20% by weight gallium and 1 to 60% by weight copper, preferably 1 to 10% by weight copper.

Certain new four component alloys have been found to be particularly advantageous in providing particularly low torsion moduli and high quality factors in taut strips. These four component alloys consist essentially of 2 to 20% by weight silver, 5 to 15% by weight gallium, 2 to 20% by weight copper, and remainder palladium with the total silver and copper content being less than 30% by weight so that the alloy contains more than 50% by weight palladium as a predominant component. A specific example of such a four component alloy is an alloy which consists essentially of 75% by weight palladium, 10% by weight silver, 10% by weight gallium, and 5% by weight copper. This alloy is included in the Table below as example 11 and has, as can be seen from the Table, expecially useful properties.

Alloys having the composition of this invention have minimum torsion moduli in the order to 3000 and maximum quality factors of about 3.70 which are substantially more favorable than the values previously considered optimum.

Eleven examples of alloys embodying this invention and the properties thereof are set forth in the following Table. The composition of the alloy according to components and weight percentages is given in the second column, the measured values for the torsion modulus (G) are shown in the middle column and the breaking tension or tensile strength ($\sigma_B$) is set forth in the fourth column. The quality factor ($Z = \sigma_B / \sqrt{G}$.) appears in the fifth or last column.

| Example | Alloy Composition | G (kp/mm²) | σAB (kp/mm²) | Z |
|---|---|---|---|---|
| 1 | Pd/In — 88/12 | 4,090 | 145 | 2.27 |
| 2 | Pd/Sn — 90/10 | 4,100 | 138 | 2.16 |
| 3 | Pd/Al — 96/4 | 4,280 | 205 | 3.14 |
| 4 | Pd/Sb — 88/12 | 3,520 | 163 | 2.75 |
| 5 | Pd/Te — 90/10 | 2,940 | 154 | 2.84 |
| 6 | Pd/Ga — 90/10 | 3,740 | 171 | 2.80 |
| 7 | 92Pd/ 4 Al/ 4 Cu | 4,960 | 216 | 3.06 |
| 8 | 92Pd/ 4 Al/ 4 Ag | 3,140 | 181 | 3.23 |
| 9 | 76Pd/ 4 Al/ 20 Ag | 3,880 | 216 | 3.47 |
| 10 | 80Pd/ 10 Ga/ 10 Cu | 3,910 | 233 | 3.73 |
| 11 | 75Pd/ 10 Ag/ 10 Ga/ 5 Cu | 3,700 | 227 | 3.73 |

Examples 1 and 2 are alloys according to the present invention having a relatively low quality factor but the torsion moduli of these alloys lie substantially below the previously attainable values which is to be desired. The other two-component alloys, Examples 3 to 6, have higher breaking strengths and higher quality factors than the alloys of Examples 1 and 2, with even lower values for torsion modulus for the alloys of Examples 4 to 6. In respect of the three-component alloys, Examples 7 to 10 and the four-component alloys exemplified by Example 11, there is an even more significant improvement in the breaking tension and the quality factors with the torsion modulus substantially lower than that of prior alloys for use in taut strips.

Although not shown in the Table, it is noteworthy that the alloys of Examples 3 and 7 to 10 have a good soldering property and a low elastic after-effect. Taking as the measure for soldering property the wetting angle between a strip of the alloy and a drop of solder, using rosin as the fluxing agent, that angle is 67° for palladium/aluminum 96/4 (Example 3), for 76% palladium/4% aluminum/20% silver the angle is 15°, for 80% palladium/10% gallium/10% copper the angle is 10° and for 75% palladium/10% gallium/10% silver/5% copper the angle is 11°. Under the same test conditions known alloys such as 90% platinum/10% nickel have a wetting angle of 23°, 80% gold/20% nickel an angle of 14° and 70% platinum/30% iridium an angle of more than 90°. Thus, the wetting angle of the 80% palladium/10% gallium/10% copper and of the 75% palladium/10% gallium/10% silver/5% copper alloy is significantly below those of the taut strip alloys in use heretofore. Since a low wetting angle is a measure of good solderability, the solderability of the alloys 80% palladium/10% gallium/10% copper and 75% palladium/10% gallium/10% silver/5% copper is substantially better than that of the previously used taut strip alloys.

The elastic after-effect for 96% palladium/4% aluminum is 0.02%, for 80% palladium/10% gallium/10% copper the elastic after-effect is 0.05% and for 75% palladium/10% gallium/10% silver/5% copper the elastic after-effect is less than 0.005%. Under the same test conditions the known alloys such as 90% platinum/10% nickel have an elastic after-effect of 0.04%, 80% gold/20% nickel an elastic after-effect of 0.05% and 70% platinum/30% nickel an elastic after-effect of 0.05%. Although the results scatter for about ± 50%, the elastic after-effect for 75% palladium/10% gallium/10% silver/5% copper is significantly below that of the previously used alloys.

In addition to the additives used in the Table, one or more of the elements listed below can also be used, according to the present invention, as a component in these palladium and/or platinum alloys: germanium, silicon, bismuth, lead, tellurium, arsenic and selenium.

Other examples of alloys which possess a low tension modulus and other properties suitable for taut strips or tension bands are platinum with 2 to 3% tin, platinum with 1 to 3% aluminum or platinum with 5 to 25% cadmium.

It will be understood that the above description of the present invention is susceptible to various modifications, changes and adaptations and the same are intended to be comprehended within the meaning and range of equivalents of the appended claims.

What is claimed is:

1. In a method of operating a measuring instrument having a rotatable meter mechanism and a taut strip, the improvement comprising providing as the taut strip, a low modulus of torsion, high quality factor alloy consisting essentially of palladium or platinum as a predominant metal, an additive of at least one element selected from the group consisting of aluminum, gallium, indium, silicon, germanium, tin, lead, arsenic, antimony, bismuth, selenium and tellurium, and at least one further element selected from the group consisting of gold, silver and copper, said additive and further element being present in such quantities that the corrosion resistance and the workability of the predominant metal is maintained.

2. The method as defined in claim 1 wherein the alloy consists essentially of 2 to 6 percent by weight aluminum, 1 to 30 percent by weight copper and/or silver, balance palladium.

3. The method as defined in claim 2 wherein the alloy consists essentially of 92 percent by weight palladium, 4 percent by weight aluminum, and 4 percent by weight copper and the quality factor Z of the taut strip is 3.06.

4. The method as defined in claim 2 wherein the alloy consists essentially of 92 percent by weight palladium, 4 percent by weight aluminum, and 4 percent by weight silver and the quality factor Z of the taut strip is 3.23.

5. The method as defined in claim 2 wherein the alloy consists essentially of 76 percent by weight palladium, 4 percent by weight aluminum, and 20 percent by weight copper and the quality factor Z of the taut strip is 3.47.

6. The method as defined in claim 1 wherein the alloy contains at least 76 percent by weight palladium or platinum.

7. The method as defined in claim 1 wherein the quality factor Z of the strip is from 3.06 to 3.73.

8. The method as defined in claim 7 wherein the alloy consists essentially of 80 percent by weight palladium, 10 percent by weight gallium, and 10 percent by weight copper, and the quality factor Z of the taut strip is 3.73.

9. The method as defined in claim 7 wherein the alloy consists essentially of 2 to 20 percent by weight silver, 5 to 15 percent by weight gallium, 2 to 20 percent by weight copper, and the remainder palladium, with the total silver and copper content being less than 30 percent by weight so that the alloy contains more than 50 percent palladium.

10. The method as defined in claim 9 wherein the alloy consists essentially of 75 percent by weight palladium, 10 percent by weight silver, 10 percent by weight gallium and 5 percent by weight copper.

11. The method as defined in claim 10 wherein the elastic after-effect of the taut strip manufactured from this alloy is less than 0.005%

12. A low modulus of torsion, high quality factor taut strip for measuring instruments, said taut strip being formed of an alloy consisting essentially of palladium or platinum as a predominant metal, an additive of at least one element selected from the group consisting of aluminum, gallium, indium, silicon, germanium, tin, lead, arsenic, antimony, bismuth, selenium and tellurium, and at least one further element selected from the group consisting of gold, silver and copper, said additive and further element being present in such quantities that the corrosion resistance and the workability of the predominant metal is maintained and wherein the quality factor Z of the taut strip is from 3.06 to 3.73.

13. The taut strip as defined in claim 12 wherein the alloy consists essentially of 2 to 6 percent by weight aluminum, 1 to 30 percent by weight copper and/or silver, balance palladium.

14. The taut strip as defined in claim 13 wherein the alloy consists essentially of 92 percent by weight palladium, 4 percent by weight aluminum, and 4 percent by weight copper and the quality factor Z of the taut strip is 3.06.

15. The taut strip as defined in claim 13 wherein the alloy consists essentially of 92 percent by weight palladium, 4 percent by weight aluminum, and 4 percent by weight silver and the quality factor Z of the taut strip is 3.23.

16. The taut strip as defined in claim 13 wherein the alloy consists essentially of 76 percent by weight palladium, 4 percent by weight aluminum, and 20 percent by weight copper and the quality factor Z of the taut strip is 3.47.

17. The taut strip as defined in claim 12 wherein the alloy contains at least 76 percent by weight palladium or platinum.

18. The taut strip as defined in claim 12 wherein the alloy consists essentially of 2 to 20 percent by weight silver, 5 to 15 percent by weight gallium, 2 to 20 percent by weight copper, and the remainder palladium, with the total silver and copper content being less than 30 percent by weight so that the alloy contains more than 50 percent palladium.

19. The taut strip as defined in claim 18 wherein the alloy consists essentially of 75 percent by weight palladium, 10 percent by weight silver, 10 percent by weight gallium and 5 percent by weight copper.

* * * * *

UNITED STATES PATENT AND TRADEMARK OFFICE

CERTIFICATE OF CORRECTION

PATENT NO. : 3,989,515

DATED : November 2nd, 1976

INVENTOR(S) : Karl H. Reiff

It is certified that error appears in the above-identified patent and that said Letters Patent are hereby corrected as shown below:

In the heading of the patent, under [63] Related U.S. Application Data, change "Ser. No. 33,007" to --Ser. No. 331,007--.

Column 3, line 15, fourth heading of the table, change "σAB" to --σB--; line 38, change "factors" to --factor--.

Column 4, line 38, change "1" to --7--; line 55, change "1" to --7--.

Signed and Sealed this

Fifteenth Day of March 1977

[SEAL]

*Attest:*

RUTH C. MASON
*Attesting Officer*

C. MARSHALL DANN
*Commissioner of Patents and Trademarks*